US010105828B2

(12) United States Patent
Wang

(10) Patent No.: US 10,105,828 B2
(45) Date of Patent: Oct. 23, 2018

(54) WRENCH STRUCTURE FOR SMALL-DISTANCE OPERATIONS

(71) Applicant: Yeo-Ming Wang, Taipei (TW)

(72) Inventor: Yeo-Ming Wang, Taipei (TW)

( * ) Notice: Subject to any disclaimer, the term of this patent is extended or adjusted under 35 U.S.C. 154(b) by 377 days.

(21) Appl. No.: 14/853,310

(22) Filed: Sep. 14, 2015

(65) Prior Publication Data

US 2017/0072544 A1 Mar. 16, 2017

(51) Int. Cl.
*B25B 13/48* (2006.01)
*B25B 13/46* (2006.01)

(52) U.S. Cl.
CPC ..... *B25B 13/463* (2013.01)

(58) Field of Classification Search
CPC ..... B25B 13/463; B25B 13/46; B25B 13/465
USPC ..... 81/63.1
See application file for complete search history.

(56) References Cited

U.S. PATENT DOCUMENTS 5,782,147 A * 7/1998 Chaconas ..... B25B 13/463 192/43.1
6,349,619 B1 2/2002 Liao
6,666,112 B2 * 12/2003 Hu ..... B25B 13/463 81/63.1
2013/0269488 A1 * 10/2013 Huang ..... B25B 13/463 81/60
2014/0083259 A1 * 3/2014 Anderson ..... B25B 13/463 81/63.1

FOREIGN PATENT DOCUMENTS

TW M423025 U1 2/2012
TW I476076 B 3/2015

* cited by examiner

*Primary Examiner* — David B Thomas
(74) *Attorney, Agent, or Firm* — Muncy, Geissler, Olds & Lowe, P.C.

(57) ABSTRACT

A wrench structure for small-distance operations includes a wrench, a driving device, a latching device and an elastic device. The wrench includes a wrench head, a central portion and a rear end which has an operation area and a slot area with two latching grooves that are vertical, parallel and overlapped with each other, each of the latching grooves having a lateral angle offset. The driving device includes a ratchet member disposed in the operation area, an outer ring portion of the ratchet member having plural driving teeth. The latching device includes two latching members, two front end surfaces of the latching members having plural teeth individually, the latching members being in the latching grooves and being connected with the plural driving teeth individually, a lateral angle offset being between the latching members. The elastic device is disposed in the slot area for urging the latching members.

16 Claims, 11 Drawing Sheets

WRENCH STRUCTURE FOR SMALL-DISTANCE OPERATIONS

BACKGROUND OF THE INVENTION

1. Field of the Invention

The present invention generally relates to a wrench structure, more particularly to a wrench structure that is simplified in the whole structure and facilitates to fabricate, and is convenient to operate in a small space and a small distance.

2. Description of the Prior Art

Ratchets are commonly used for facilitating to tighten and loosen a screw/nut and other kinds of positioning workpieces. A present ratchet wrench comprises at least one head that has an operation area. The operation area has a ratchet driving member and is to accommodate a screw rod or nuts. After fitting the ratchet driving member with the screw rod/nut, a rotational force is applied to a handle for tightening and loosing the screw rod/nut. Since the ratchet wrench is in an extremely limited space, the angle and distance of rotating and pulling back the wrench may be small and short, so that the wrench does not move one-pitch distance, and it must be immediately returned. This is called an idle condition for the wrench not working (means the wrench cannot lock) due to the limited space. Although the teeth of the ratchet wrench can be smaller in order to increase the possibility of the driving member overstriding to lock while in rotation, the ratio of the teeth shall consider the whole dimensions of a ratchet member so as to prevent insufficient torque or collapsed teeth while in driving.

A prior art, No. I476076, for such ratchet wrench teaches a torque tool. That is, a hollow driving body accommodates a rotating body, and the driving body surrounds the rotating body for swivel through a control mechanism, and reversely and synchronously drives the rotating body. The control mechanism has a selector between the inner surface of the driving body and the outer portion of the rotating body, and the inner side itself forms plural thin wall portions and thick wall portions. A latching structure has a plurality of teeth and a set of latching members. Applying one of the teeth or latching member to the torque member may be two different embodiments. For teeth, they continuously protrude from the inner surface, surrounding the rotating body, of the driving body. For latching members, they are actively distributed on a portion, facing to the teeth, of the rotating body. The latching members are activated toward the teeth by elastic forces, and moves between an engagement position and a release position. Accordingly, for teeth, they continuously protrude from the outer surface of the rotating body. For latching members, they are actively distributed on a portion, facing to the teeth, of the driving body. The latching members are activated toward the teeth by elastic forces, and moves between an engagement position and a release position. When the driving body is in an idle rotation, corresponding to the rotating member, along a one-way direction, the portion, facing to the latching member, of the thick wall portion may collect redundant latching members and only keeps one single tooth of the latching member. The portion, facing to the latching member, of the thin wall portion releases some latching members to engage with the teeth one by one, and the other latching members then disengage with the other teeth. Therefore, it approaches the reduction of the minimum idle rotation and efficiency without changing the number of the teeth. However, the prior art, No. I476076, still has some disadvantages. For example, the fabrications for the rotating member, the control mechanism and the latching member are complicated, so it is not favorable for manufacturing cost. Further, the two latching members being disposed at two different positions with a larger angle, assembly tolerances, each of the two latching member being worn in a different state, etc., the aforesaid causes an asynchronous condition for failure operations.

Another prior art, No. M423025 and titled as "improved structure for one-way ratchet wrench to facilitate assembly", comprises a ratchet wrench body and an arcuate member. A ratchet head of the ratchet wrench body has an accommodation hole that is for a ratchet. A peripheral surface of the ratchet is a ratchet surface. A side surface of the accommodation hole has an arcuate slot. The arcuate member comprises an arcuate member, a spring and a ratchet member. The ratchet member has a pillar and plural ratchet teeth toward the ratchet member. The arcuate member has a spring-accommodation hole. The pillar and the spring-accommodation hole are fabricated to limit the spring. An elongation plate of the arcuate member is extended toward one side of the ratchet member, and therefore only one hand is able to hold to assemble the ratchet member, the spring and the elongation plate. Accordingly, the disadvantages are described below. The shape of the ratchet tooth of the ratchet member and the shape of the ratchet head are important when the ratchet member engages with the ratchet head. That is, the two shapes are related to the angle of rotating the ratchet wrench. On the other hand, the size of the tooth is related to the whole dimensions of the ratchet head, and its dimensions cannot be reduced all the time. The torque force may not be enough or the tooth is collapsed when the ratchet wrench drives a driven member and its teeth are not large enough.

Accordingly, the inventor has studied some related skills in order to develop a wrench structure for small-distance operations, so that such related technologies may be improved.

SUMMARY OF THE INVENTION

The main objective of the present invention is to provide a wrench structure for small-distance operations, and it is able to be fabricated in a simple and precise way. The ratchet wrench is able to operate in an extremely limited space, so as to reduce the possibility of failure operations and increase the features of facilitating manufacturing, assembly and efficiency.

In order to achieve above objective, the present invention adopts a technology, and it comprises that of: a wrench, comprising a wrench head, a central portion of the wrench head having an operation area, a rear end of the wrench head corresponding to the operation area having a slot area, the slot area having a first latching groove and a second latching groove that are vertically arranged, parallel and overlapped to each other, and each of the first latching groove and the second latching groove having a lateral angle offset; a driving device, comprising a ratchet member that is disposed in the operation area, an outer ring portion of the ratchet member being a plurality of driving teeth; a latching device, comprising a first latching member and a second latching member, two front end surfaces of the first latching member and the second latching member having a plurality of teeth individually, the first latching member being in the first latching groove, and the second latching member being in the second latching groove, the first latching member and the second latching member being connected with the plurality of driving teeth of the ratchet member individually, a lateral angle offset being between the first latching member and the second latching member; and an elastic device, disposed in the slot area for urging the first latching member and the second latching member.

In order to achieve the above objective, the present invention adopts another technology, and it comprises that of: a wrench, comprising a wrench head, a central portion of the wrench head having an operation area, a rear end of the wrench head corresponding to the operation area having a slot area, the slot area having a first latching groove and a second latching groove that are vertically arranged, parallel and overlapped to each other, and each of the first latching groove and the second latching groove having a lateral angle offset; a driving device, being in the operation area, comprising a first ratchet member and a second ratchet member that are vertically arranged, parallel and overlapped to each other, each of two outer ring portions of the first ratchet member and the second ratchet member being a plurality of driving teeth; a latching device, comprising a first latching member (31) and a second latching member, two front end surfaces of the first latching member and the second latching member having a plurality of teeth individually, the first latching member being in the first latching groove, and the second latching member being in the second latching groove, the first latching member and the second latching member being connected with the plurality of driving teeth of the first ratchet member and the second ratchet member individually, a lateral angle offset being between the first latching member and the second latching member; and an elastic device, disposed in the slot area for urging the first latching member and the second latching member.

Accordingly, a lateral angle between teeth is defined as an axial angle of a tooth peak or a tooth trough corresponding to the central portion of an operation area. A lateral angle offset is defined as an axial angle offset between the tooth of a first latching member and the tooth of a second latching member that is the most adjacent to the tooth of the first latching member.

Accordingly, the first latching member and the second latching member are overlapped along a vertical direction (the extension direction of the teeth).

Accordingly, a lateral angle offset is defined as an angle offset between the tooth of the first latching member and the tooth of the second latching member that is the most adjacent to the tooth of the first latching member.

Accordingly, the lateral angle offset is between 0 and 360/N degree, wherein N is the number of the driving teeth of the ratchet member.

Accordingly, the lateral angle offset is between 3 and 6 degree, or between 2 and 6 degree.

Accordingly, the lateral angle offset is between 2.5 and 5 degree, or between 5/3 and 5 degree.

Accordingly, the lateral angle offset is between 1.25 and 2.5 degree, or between 2.5/3 and 2.5 degree.

Accordingly, a partition member is between the first latching groove and the second latching groove.

Accordingly, the elastic device comprises a first elastic member and a second elastic member that urge the first latching member and the second latching member individually.

Accordingly, the rear end of the slot area of the wrench head further comprises a wrench handle adjacent to the wrench head and a reversing switch, a reversing slot of the wrench head is neighbor to the wrench handle, a lower portion of the reversing switch is a positioning pillar, an upper portion of the reversing switch is a pulling member, the positioning pillar is pivotally connected with the reversing slot, the positioning pillar comprises at least one spring slot that is in the elastic device.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objects.

Figure 1:
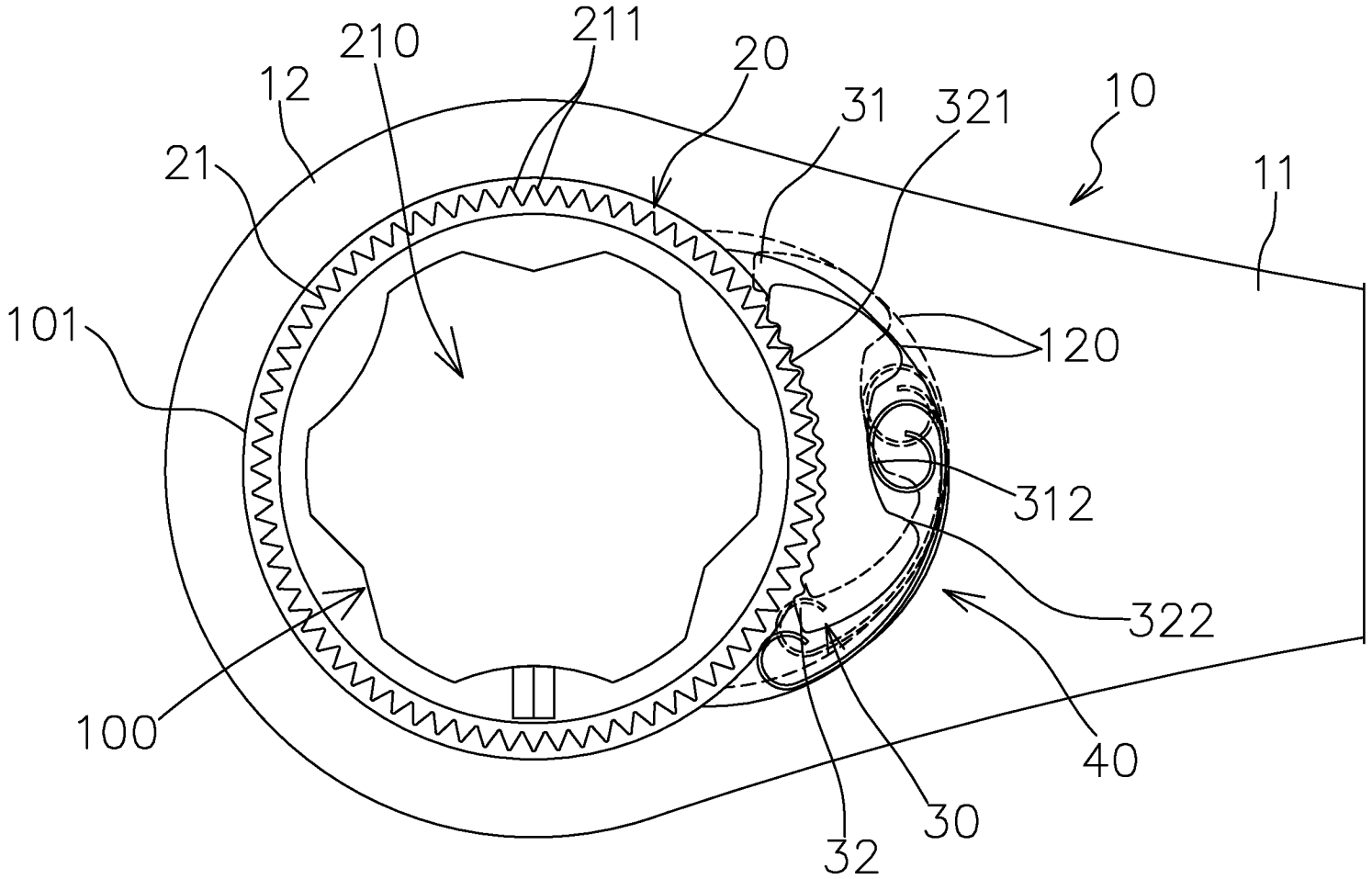
FIG. 1 illustrates a schematic top view of a first embodiment of the present invention.
Figure 2:
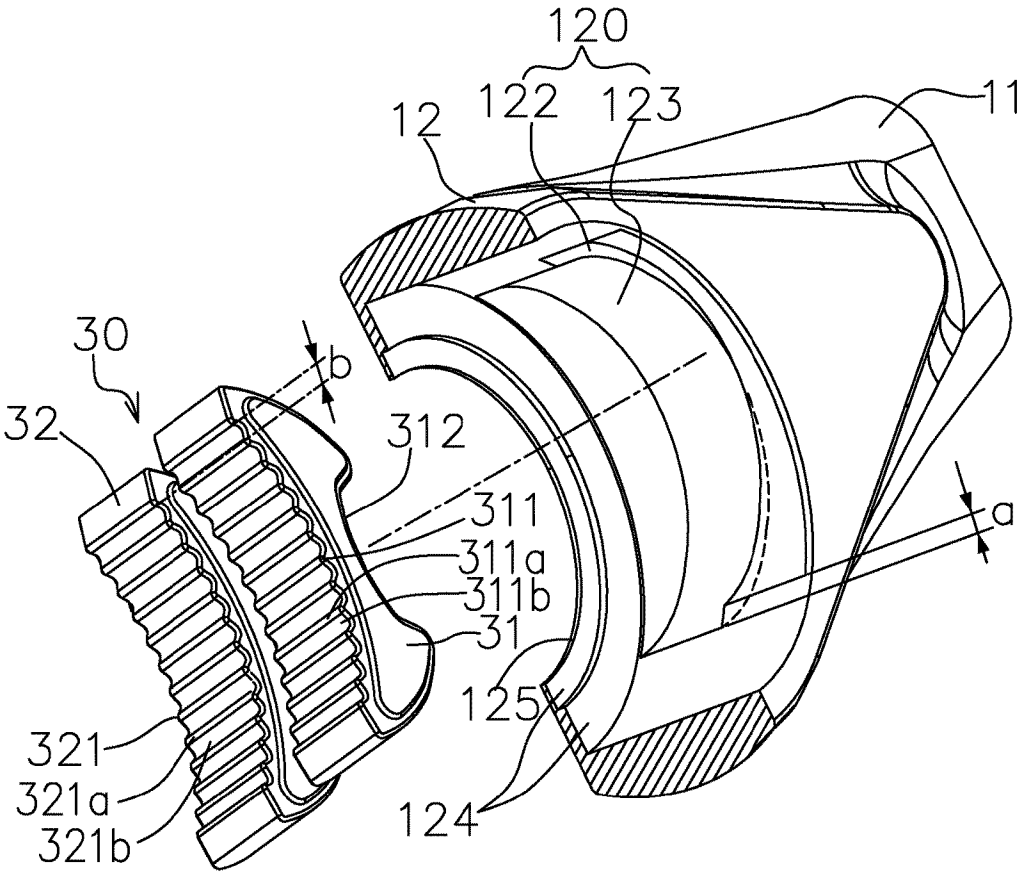
FIG. 2 illustrates a schematic exploded and partially sectional view of the first embodiment of the present invention.
Figure 4:
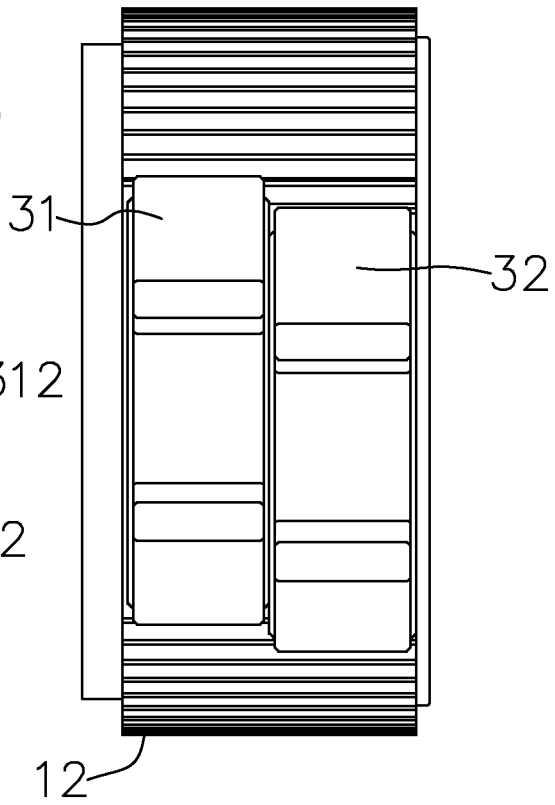
FIG. 4 illustrates a partially schematic side view of the first embodiment of the present invention.
Figure 3:
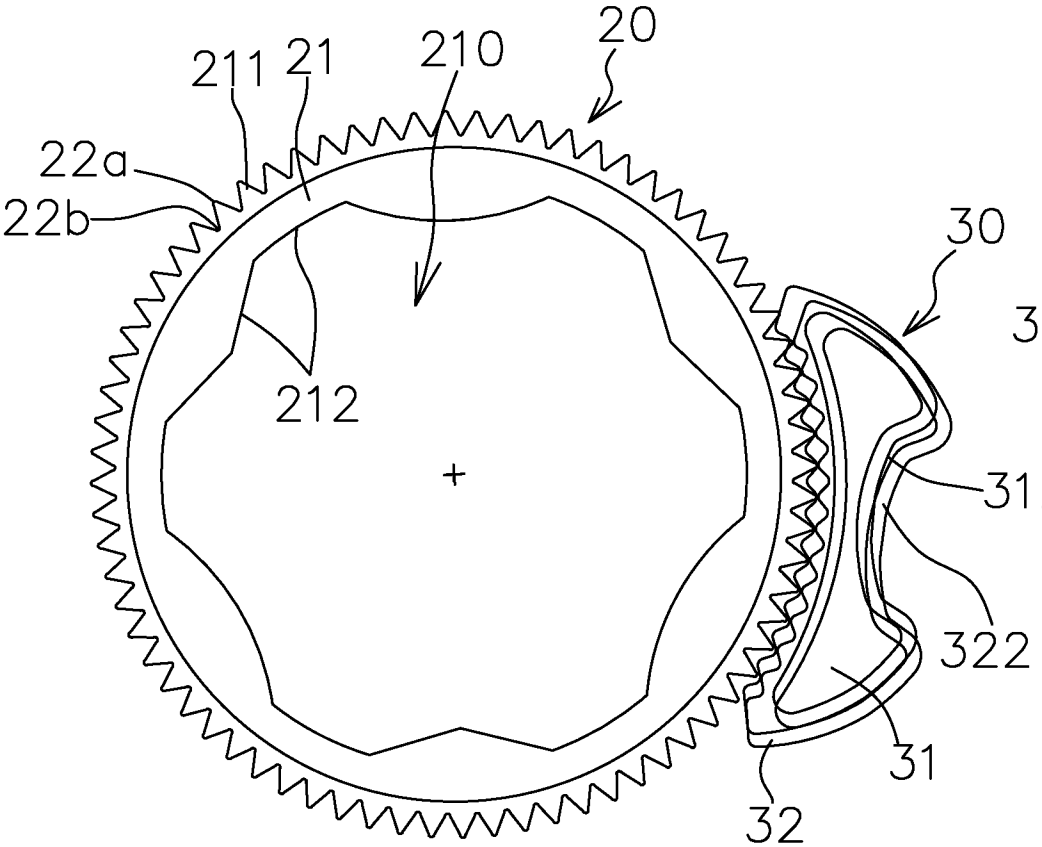
FIG. 3 illustrates a partially schematic top view of the first embodiment of the present invention.
Figure 5:
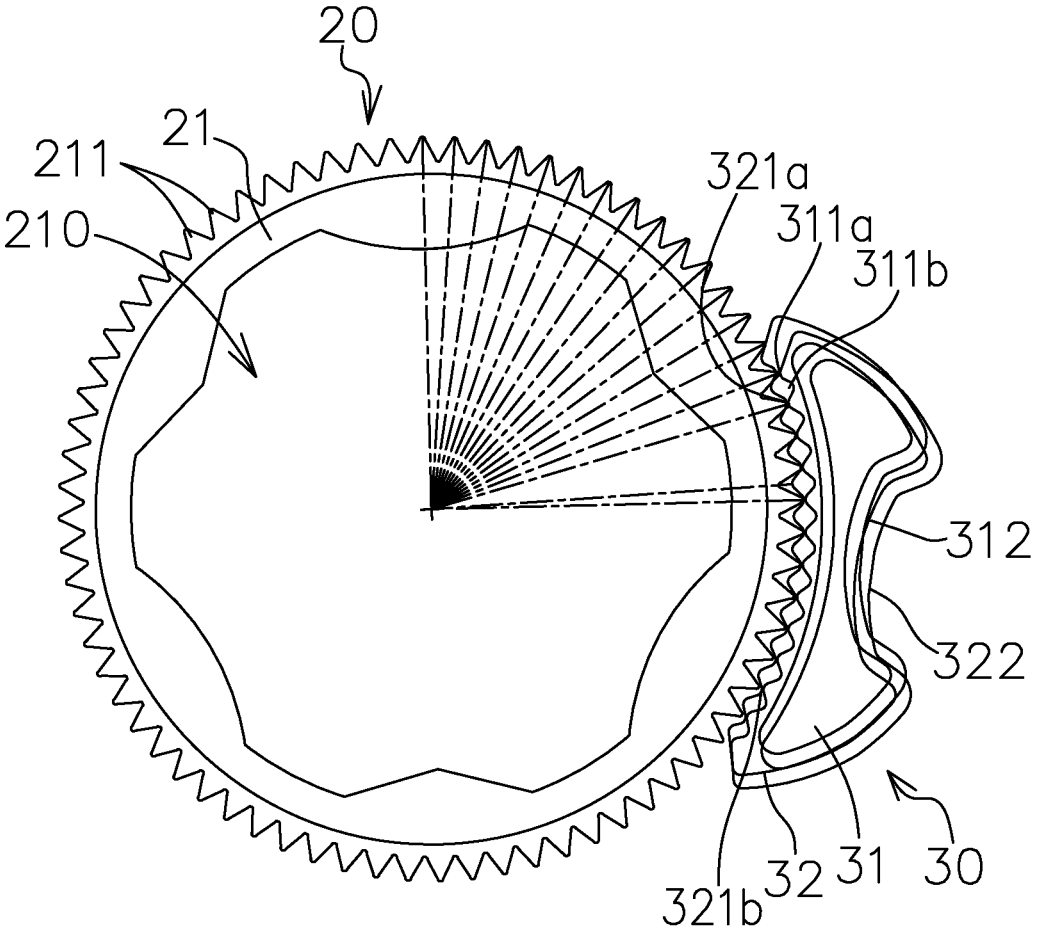
FIG. 5 illustrates a schematic top operational view of the first embodiment of the present invention.

Please refer to FIG. 1 to FIG. 5, which illustrate a first preferred embodiment of a wrench structure for small-distance operations of the present invention. The embodiment has a wrench 10, a driving device 20, a latching device 30, and an elastic device 40. The wrench 10 includes a wrench handle 11 and a wrench head 12, a central portion of the wrench head 12 has an operation area 100. The operation area 100 has a ratchet accommodation ring 101. A rear end (based on the direction of FIG. 2) of the wrench head 12 corresponding to the operation area 100 has a slot area 120, and the slot area 120 further has an upper first latching groove 122 and a lower second latching groove 123 that are vertically arranged, parallel, overlapped, and connected to each other. Each of the first latching groove 122 and the second latching groove 123 has a lateral angle offset along a lateral position. In other words, a lateral displacement difference a (as shown in FIG. 2) is between the first latching groove 122 and the second latching groove 123. That is, at one side of the slot area 120, the first latching groove 122 designed for retraction is more than the second latching groove 123; for another side, the first latching groove 122 protrudes further if comparing with the second latching groove 123. More, a central open 125 and a connecting ring portion 124 around the central open 125 are disposed beneath the operation area 100 of the wrench head 12.

The driving device 20 has a ratchet member 21 that is in the ratchet accommodation ring 101 (operation area 100) of the wrench head 12 and on the connecting ring portion 124. An outer ring portion of the ratchet member 21 is a plurality of driving teeth 211, and the driving tooth 211 includes a tooth peak 22*a* and a tooth trough 22*b*. For the embodiment, the inner side of the ratchet member 21 is a driving space 210, and the peripheral of the driving space 210 is a curve wall 212 in order to fit in with a driven member (such as nut, screw rod, etc.); on the other embodiment, the inner side of the driving space 210 can be disposed a driving rod (not shown in figure), so as to drive a corresponding driven member.

The latching device 30 has a first latching member 31 and a second latching member 32. The front end surface of the first latching member 31 has a plurality of teeth 311, and the rear end surface of the first latching member 31 is an urging portion 312, and the tooth 311 includes a tooth peak 311*a* and a tooth trough 311*b*; likewise, the front end surface of the second latching member 32 has a plurality of teeth 321, and the rear end surface of the second latching member 32 is an urging portion 322, and the tooth 321 includes a tooth peak 321*a* and a tooth trough 321*b*. The latching device 30 is disposed in the slot area 120, that is, the first latching member 31 is in the first latching groove 122 relatively; the second latching member 32 is in the second latching groove 123 as well, so as to connect the first latching member 31 and the second latching member 32 with the ratchet member 21, that is to say, the plural teeth 311 and the plural teeth 321 are connected with the driving teeth 211 in the same time. More, due to that each of the first latching groove 122 and the second latching groove 123 has a lateral angle offset, the ratchet member 21 has a lateral angle offset correspondingly after assembling the first latching groove 122 and the second latching groove 123. Therefore, a lateral displacement difference b (as shown in FIG. 2) is between the first latching member 31 and the second latching member 32. The lateral angle offset is defined as that an angle offset between the tooth 311 of the first latching member 31 and the tooth 321 of the second latching member 32, wherein the tooth 321 is the most adjacent to the tooth 311. For a preferred embodiment, the first latching member 31 and the second latching member 32 are overlapped along a vertical direction (the extension direction of the teeth).

The elastic device 40 is disposed at the rear portion of the latching device 30, that is, the elastic device 40 is in the slot area 120 in order to urge the urging portions 312, 322. Hence, by way of the elastic force of the elastic device 40, the first latching member 31 and the second latching member 32 are against to the inner side of one end of the slot area 120 and the plurality of driving teeth 211 of the ratchet member 21.

After fabricating the wrench structure for small-distance operations, the first latching member 31 and the second latching member 32 are connected with the ratchet member 21, a lateral angle offset is between the first latching member 31 and the second latching member 32 since a lateral angle offset is between the first latching groove 122 and the second latching groove 123 and the elastic force from the elastic device 40. Hence, while rotating the ratchet member 21 (wrench 10) in a small distance, the tooth peak 321*a* of the second latching member 32 is just overstriding the tooth peak 22*a* of the driving tooth 211 because of a small-distance movement, and the tooth peak 311*a* of the first latching member 31 is not overstriding the tooth peak 22*a* of the driving tooth 211 yet, so that a latching effect is thus happening from the second latching member 32, and an idle state for the wrench 10 may be avoided for continuously rotating the wrench 10.

According to that the first latching member 31 and the second latching member 32 are in the first latching groove 122 and the second latching groove 123, the arrangement of the lateral angle offset, corresponding to the ratchet member 21 (the plural driving teeth 211), between the first latching member 31 and the second latching member 32 is automatically generated, so that it is easily and accurately assembled without other positioning fixtures. On the other hand, due to the lateral angle offset between the first latching member 31 and the second latching member 32, the first latching member 31 and the second latching member 32 can be used individually even they are integrated in one member, so that the whole structure is simplified for increasing economic efficiency.

For the lateral angle offset between the first latching member 31 and the second latching member 32 corresponding to the ratchet member 21, and an embodiment with the conditions of a 60-tooth ratchet member and 6 degree (360 degree/60=6 degree) of an angle of one tooth, the lateral angle offset is between 0 and 360/N degree, but the preferred embodiment is 3 to 6 degree or 2 to 6 degree.

If the ratchet member 21 has 72 teeth and 5 degree (360 degree/72=5 degree) of an angle of one tooth, the preferred embodiment of the lateral angle offset is between 2.5 and 5 degree or 5/3 to 5 degree.

If the ratchet member 21 has 144 teeth and 2.5 degree (360 degree/144=2.5 degree) of an angle of one tooth, the lateral angle offset is between 0 and 2.5 degree, and a preferred embodiment of the lateral angle offset is between 1.25 and 2.5 or between 2.5/3 and 2.5. Accordingly, for three kinds of the ratchet member 21 as 60-teeth, 72-teeth and 144-teeth, the lateral angle offset is between 0 and 6 degree.

Wherein N is the number of the driving teeth of the ratchet member.

Wherein the limits of the lateral angle offset are not 0 and 360/N.

Figure 6:
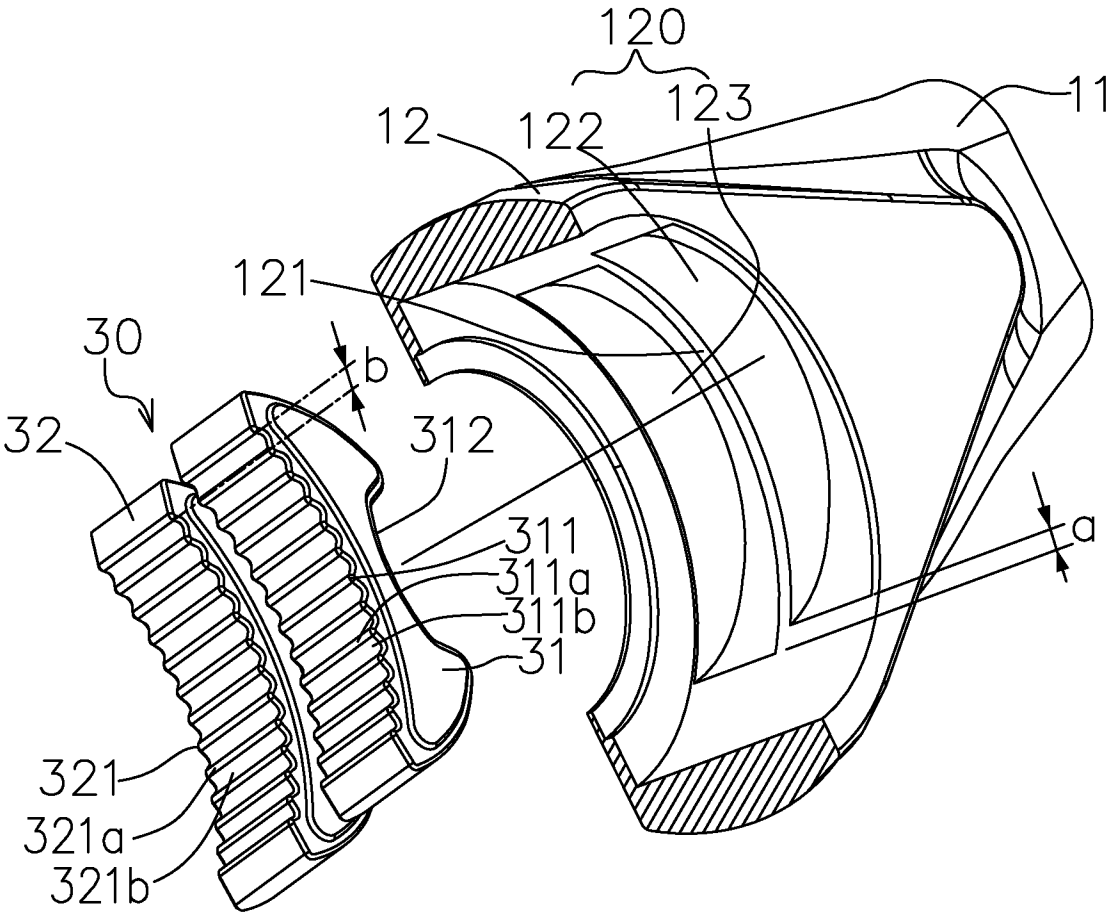
FIG. 6 illustrates a schematic exploded and partially sectional view of a second embodiment of the present invention.

Please refer to FIG. 6, which illustrates a second preferred embodiment of the wrench structure for small-distance operations of the present invention. The second preferred embodiment is a variety that is based on the first preferred embodiment. The differences are described as following. The slot area 120 has the first latching groove 122 and the second latching groove 123 that are connected to each other. A partition member 121 is between the first latching groove 122 and the second latching groove 123, so as to facilitate the individual installment of the first latching member 31 and a second latching member 32.

Figure 7:
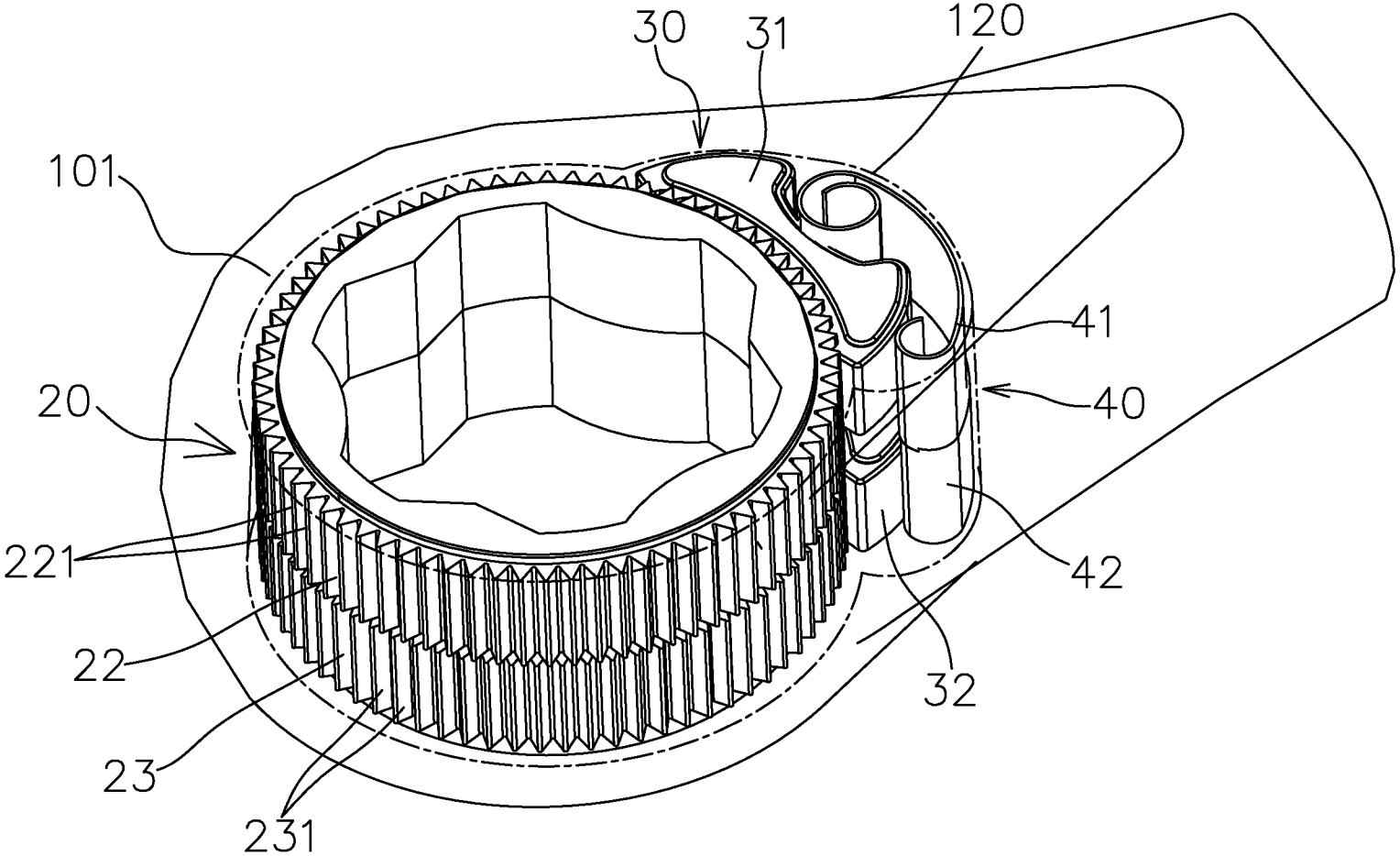
FIG. 7 illustrates a schematic structural view of a third embodiment of the present invention.

Please refer to FIG. 7, which illustrates a third preferred embodiment of the wrench structure for small-distance operations of the present invention. The third preferred embodiment is another variety that is based on the first preferred embodiment. The differences are described as following. The driving device 20 has two ratchet members, that is, a first ratchet member 22 and a second ratchet member 23 that are vertically arranged, parallel and overlapped to each other. Each of two outer ring portions of the first ratchet member 22 and the second ratchet member 23 is a plurality of driving teeth 221, 231, wherein the first ratchet member 22 is connected with the first latching member 31, and the second ratchet member 23 is connected with the second latching member 32. The elastic device 40A includes a first elastic member 41 and a second elastic member 42 that urge the first ratchet member 22 and the second ratchet member 23 individually.

Figure 8:
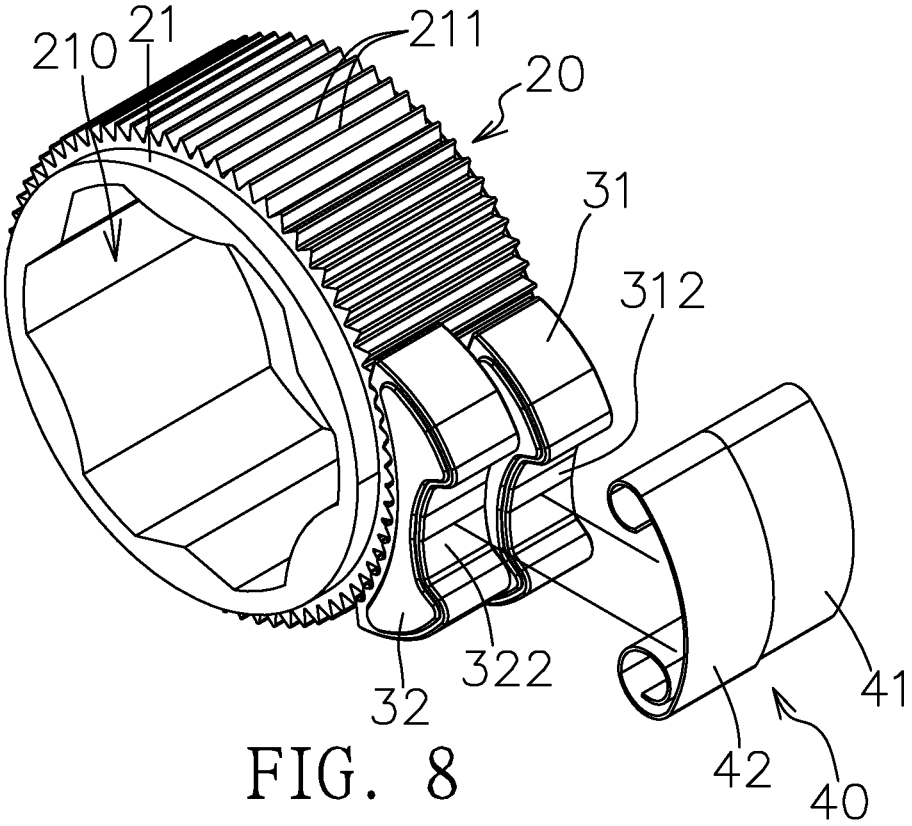
FIG. 8 illustrates a schematic structural view of a variety of the third embodiment of the present invention.

As shown in FIG. 8, under the condition of the elastic device 40 including the first elastic member 41 and the second elastic member 42, each of the first ratchet member 21 and the second ratchet member 23 of the driving device 20 can work individually.

Figure 9:
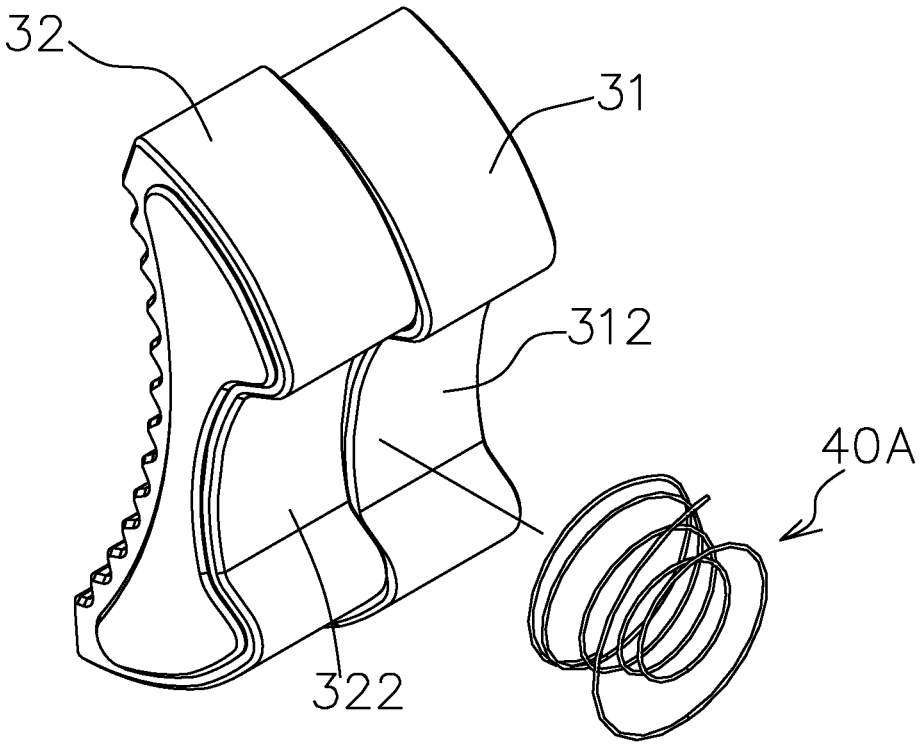
FIG. 9 illustrates a schematic structural view of another variety of the third embodiment of the present invention.

As shown in FIG. 9, the elastic device 40A is fabricated by one single wire (or two wires) via coiling as well, but it is not limited thereto.

Figure 10:
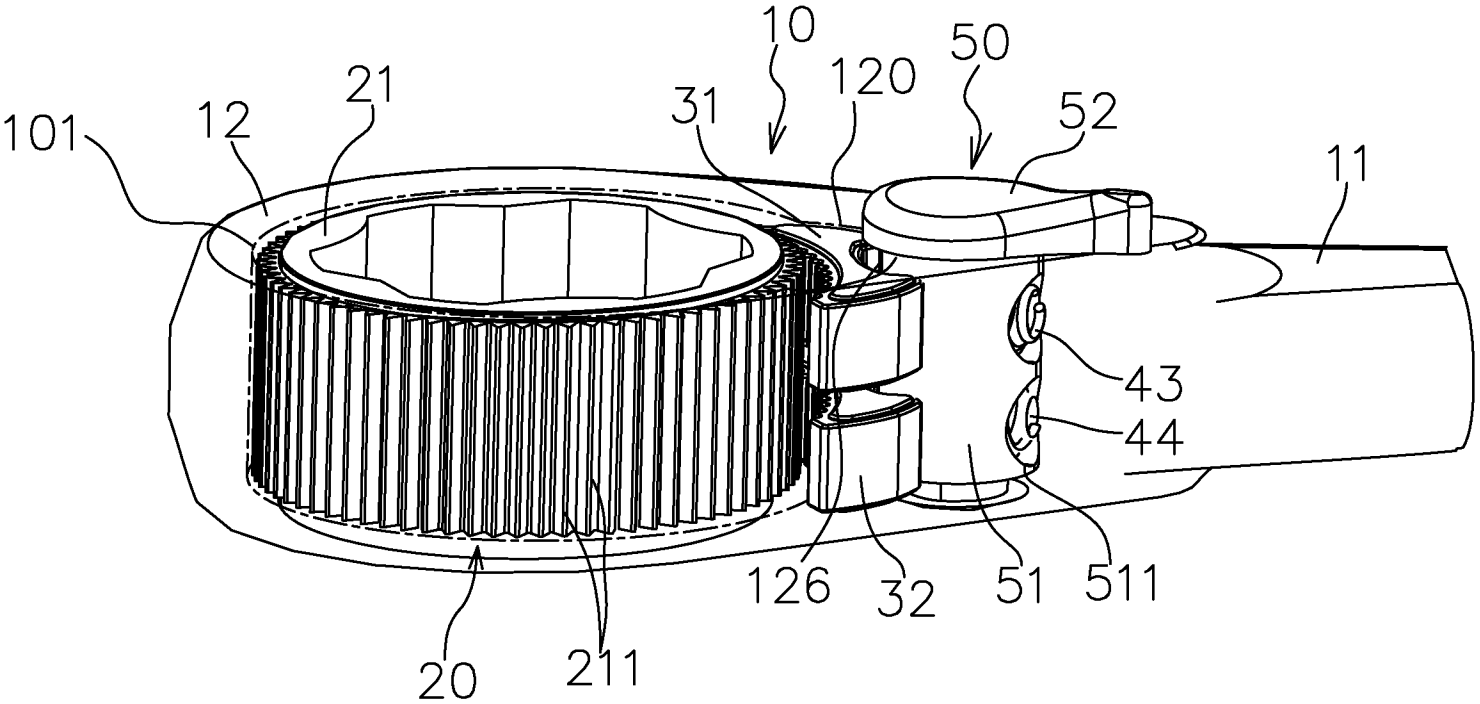
FIG. 10 illustrates a schematic structural view I of a fourth embodiment of the present invention.
Figure 11:
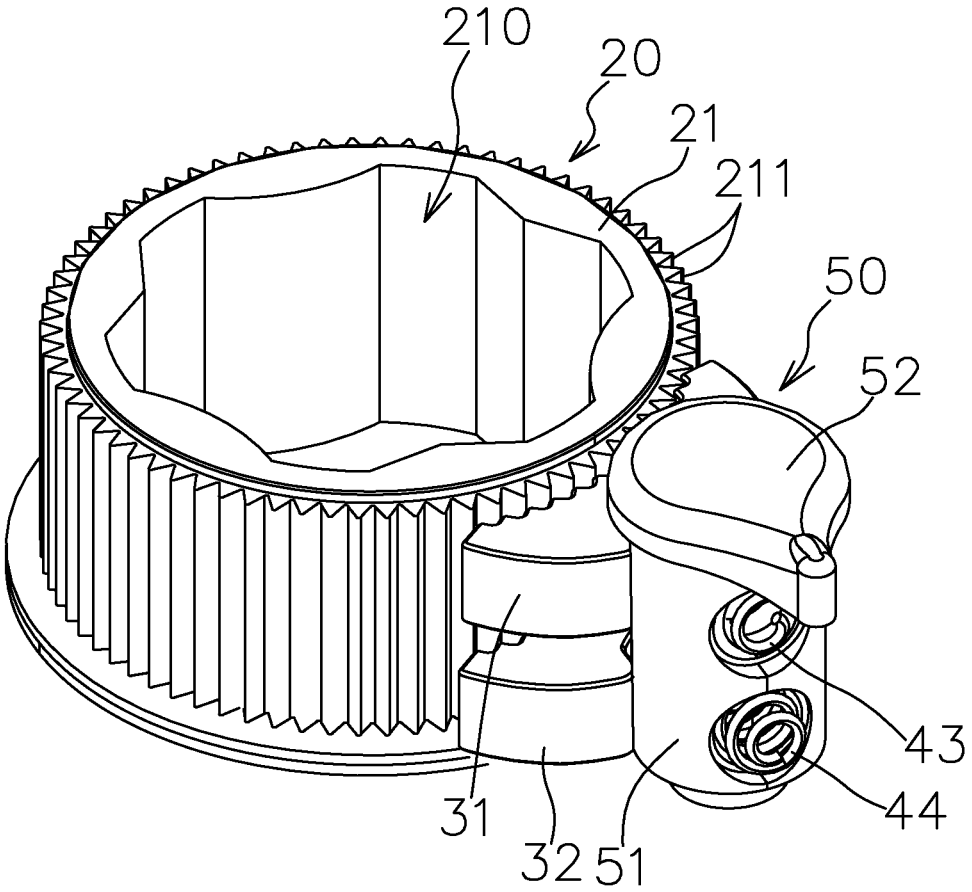
FIG. 11 illustrates a schematic structural view II of the fourth embodiment of the present invention.

Please refer to FIG. 10 and FIG. 11, which illustrates a fourth preferred embodiment of the wrench structure for small-distance operations of the present invention. The fourth preferred embodiment is another variety that is based on the first preferred embodiment. The differences are described as following. A reversing slot 126 of the wrench head 12 is neighbor to the wrench handle 11 (it means the rear end of the wrench head 12). Further, there is one more reversing switch 50, and a lower portion of the reversing switch 50 is a positioning pillar 51, and an upper portion of the reversing switch 50 is a pulling member 52. The positioning pillar 51 is pivotally connected with the reversing slot 126, in order to switch the driving direction of the driving device 20. The positioning pillar 51 has two spring slots 511, and each of the spring slot 511 is able to set two elastic members 43, 44. The two elastic members 43, 44 urge the first latching member 31 and the second latching member 32 individually.

Figure 12:
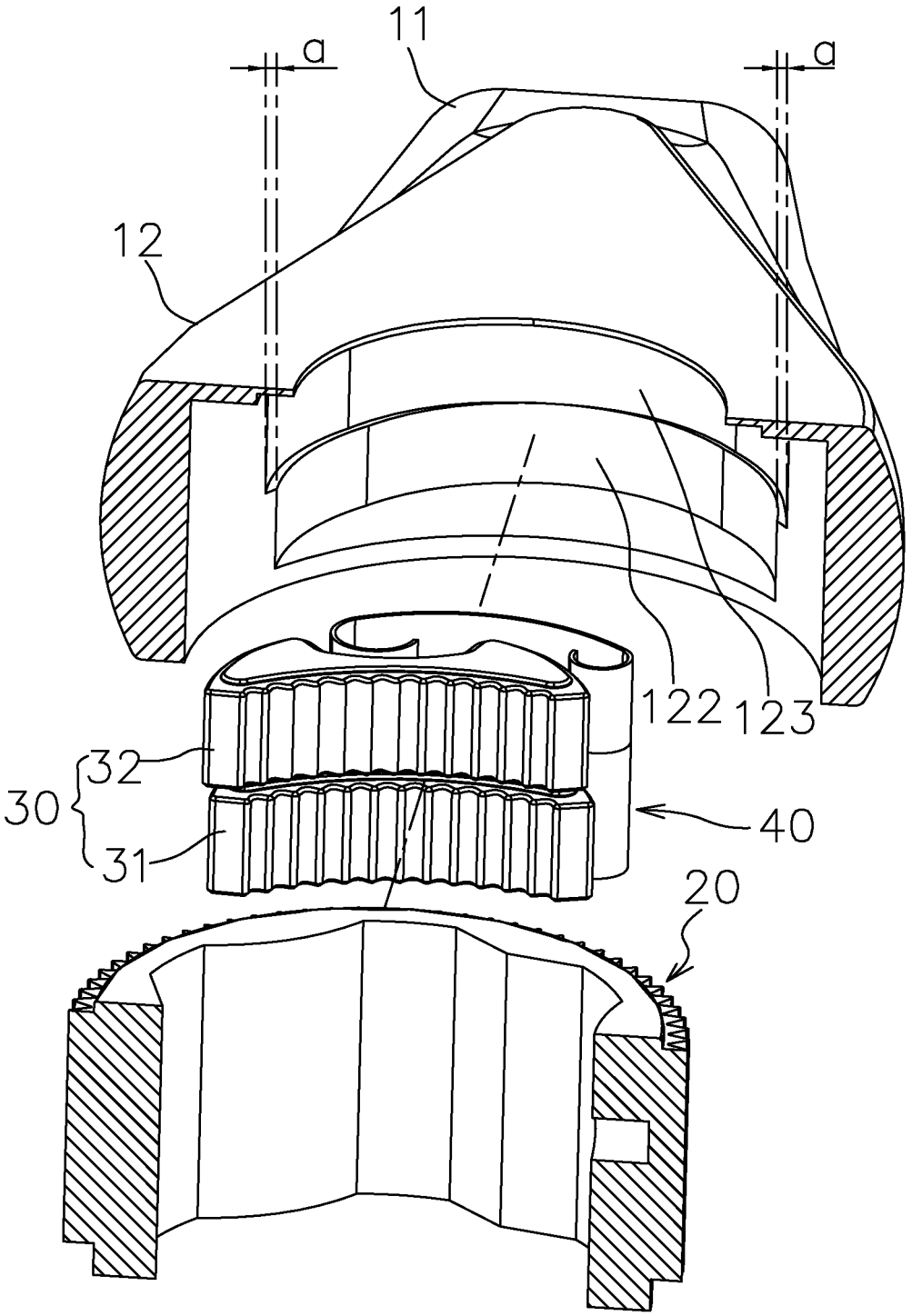
FIG. 12 illustrates a schematic structural view I of a fifth embodiment of the present invention.
Figure 13:
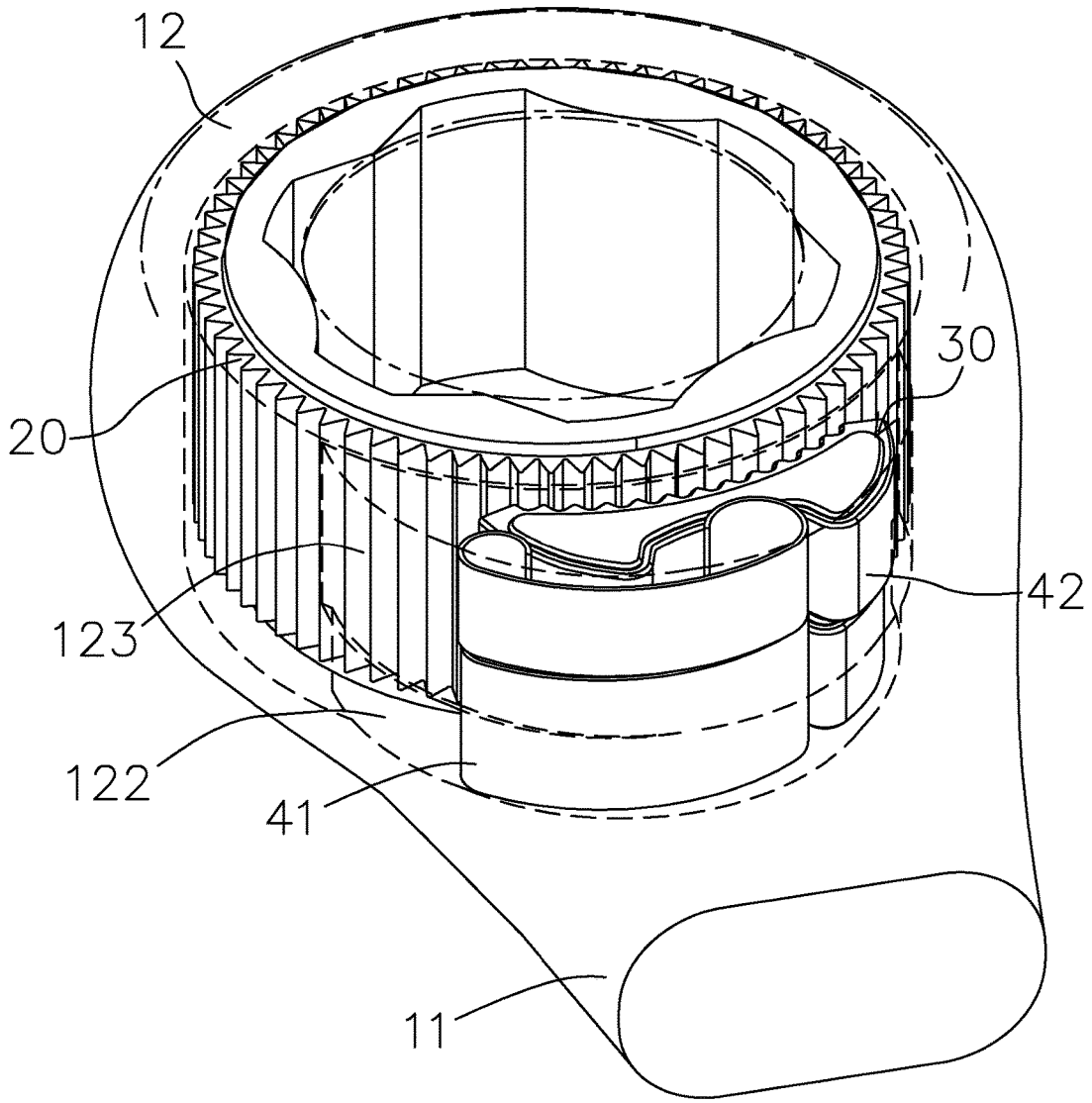
FIG. 13 illustrates a schematic structural view II of the fifth embodiment of the present invention.

Please refer to FIG. 12 and FIG. 13, which illustrate a fifth preferred embodiment of the wrench structure for small-distance operations of the present invention. The fifth preferred embodiment is a variety that is based on the first preferred embodiment. The differences are described as following. The first latching groove 122 and the second latching groove 123 are not equal to each other in dimension. For the embodiment, the second latching groove 123 is larger than the first latching groove 122. That is, the lateral displacement difference a is between the two sides of the first latching groove 122 and the two sides of the second latching groove 123, so that the upper one is larger than the lower one (according to the direction of figure). Similarly, which being larger or smaller and whether the lateral displacement difference a being the same are not limited thereto.

Therefore, the present invention providing the wrench structure for small-distance operations is able to be fabricated in a simple and precise way. The ratchet wrench is able to operate in an extremely limited space, so as to reduce the possibility of failure operations and increase the features of facilitating manufacturing, assembly and efficiency.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A wrench structure for small-distance operations comprising:

a wrench, comprising a wrench head, a central portion of the wrench head having an operation area, a rear end of the wrench head corresponding to the operation area having a slot area, the slot area having a first latching groove and a second latching groove that are vertically arranged, parallel and overlapped to each other, and each of the first latching groove and the second latching groove having a lateral angle offset;

a driving device, comprising a ratchet member that is disposed in the operation area, an outer ring portion of the ratchet member being a plurality of driving teeth, each of the plurality of driving teeth includes a tooth peak and a tooth trough;

a latching device, comprising a first latching member and a second latching member, two front end surfaces of the first latching member and the second latching member having a plurality of teeth continuously arrayed individually, and a rear end surface of the first latching member is a first urging portion, and each of the plurality of teeth includes a tooth peak and a tooth trough, a front end surface of the second latching member has a plurality of teeth, and a rear end surface of the second latching member is a second urging portion, and each of the plurality of teeth includes a tooth peak and a tooth trough, the first latching member being in the first latching groove, and the second latching member being in the second latching groove, the first latching member and the second latching member being connected with the plurality of driving teeth of the ratchet member individually, a lateral angle offset being between the first latching member and the second latching member; and an elastic device, disposed in the slot area for urging the first latching member and the second latching member;

the first latching member and the second latching member are connected with the ratchet member, a lateral angle offset is between the first latching member and the second latching member, since a lateral angle offset is between the first latching groove and the second latching groove and the elastic force from the elastic device, hence, while rotating the ratchet member a small distance, the tooth peak of the second latching member just overstrides the tooth peak of the driving tooth because of a small-distance movement, and the tooth peak of the first latching member does not overstride the tooth peak of the driving tooth yet, so that a latching effect thus happens from the second latching member, and an idle state for the wrench is avoided for continuously rotating the wrench.

2. The wrench structure for small-distance operations according to claim 1, wherein the lateral angle offset is defined as an angle offset between the tooth of the first latching member and the tooth of the second latching member that is the most adjacent to the tooth of the first latching member.

3. The wrench structure for small-distance operations according to claim 2, wherein the lateral angle offset is between 0 and 360/N degree wherein N is the number of driving teeth of the ratchet member.

4. The wrench structure for small-distance operations according to claim 2, wherein the lateral angle offset is between 3 and 6 degree, or between 2 and 6 degree when the ratchet member has 60 teeth; wherein the lateral angle offset is between 2.5 and 5 degree, or between 1.67 and 5 degree when the ratchet member has 72 teeth; wherein the lateral angle offset is between 1.25 and 2.5 degree, or between 0.83 and 2.5 degree when the ratchet member has 144 teeth.

5. The wrench structure for small-distance operations according to claim 1, wherein the first latching groove and the second latching groove are connected with each other, or a partition member is between the first latching groove and the second latching groove.

6. The wrench structure for small-distance operations according to claim 1, wherein the elastic device further comprises a first elastic member and a second elastic member that urge the first latching member and the second latching member individually.

7. The wrench structure for small-distance operations according to claim 1, wherein the wrench further comprising a wrench handle adjacent to the wrench head and a reversing switch, a reversing slot of the wrench head being neighbor to the wrench handle, a lower portion of the reversing switch being a positioning pillar, an upper portion of the reversing switch being a pulling member, the positioning pillar being pivotally connected with the reversing slot, the positioning pillar comprising at least one spring slot that is in the elastic device.

8. The wrench structure for small-distance operations according to claim 1, wherein the first latching groove and the second latching groove are not equal to each other in dimension.

9. A wrench structure for small-distance operations comprising:

a wrench, comprising a wrench head, a central portion of the wrench head having an operation area, a rear end of the wrench head corresponding to the operation area having a slot area, the slot area having a first latching groove and a second latching groove that are vertically arranged, parallel and overlapped to each other, and each of the first latching groove and the second latching groove having a lateral angle offset;

a driving device, being in the operation area, comprising a first ratchet member and a second ratchet member that are vertically arranged, parallel and overlapped to each other, each of two outer ring portions of the first ratchet member and the second ratchet member being a plurality of driving teeth, each of the plurality of driving teeth includes a tooth peak and a tooth trough;

a latching device, comprising a first latching member and a second latching member, two front end surfaces of the first latching member and the second latching member having a plurality of teeth continuously arrayed individually, and a rear end surface of the first latching member is a first urging portion, and each of the plurality of teeth includes a tooth peak and a tooth trough, a front end surface of the second latching member has a plurality of teeth, and a rear end surface of the second latching member is a second urging portion, and each of the plurality of teeth includes a tooth peak and a tooth trough, the first latching member being in the first latching groove, and the second latching member being in the second latching groove, the first latching member and the second latching member being connected with the plurality of driving teeth of the first ratchet member and the second ratchet member individually, a lateral angle offset being between the first latching member and the second latching member; and an elastic device, disposed in the slot area for urging the first latching member and the second latching member;

the first latching member and the second latching member are connected with the ratchet member, a lateral angle offset is between the first latching member and the second latching member, since a lateral angle offset is between the first latching groove and the second latching groove and the elastic force from the elastic device, hence, while rotating the ratchet member a small distance, the tooth peak of the second latching member just overstrides the tooth peak of the driving tooth because of a small-distance movement, and the tooth peak of the first latching member does not overstride the tooth peak of the driving tooth yet, so that a latching effect thus happens from the second latching member, and an idle state for the wrench is avoided for continuously rotating the wrench.

10. The wrench structure for small-distance operations according to claim 9, wherein the lateral angle offset is defined as an angle offset between the tooth of the first latching member and the tooth of the second latching member that is the most adjacent to the tooth of the first latching member.

11. The wrench structure for small-distance operations according to claim 10, wherein the lateral angle offset is between 0 and 360/N degree wherein N is the number of driving teeth of the ratchet member.

12. The wrench structure for small-distance operations according to claim 9, wherein the first latching groove and the second latching groove are connected with each other, or a partition member is between the first latching groove and the second latching groove.

13. The wrench structure for small-distance operations according to claim 9, wherein the elastic device further comprises a first elastic member and a second elastic member that urge the first latching member and the second latching member individually.

14. The wrench structure for small-distance operations according to claim 9, wherein the wrench further comprising a wrench handle adjacent to the wrench head and a reversing switch, a reversing slot of the wrench head being neighbor to the wrench handle, a lower portion of the reversing switch being a positioning pillar, an upper portion of the reversing switch being a pulling member, the positioning pillar being pivotally connected with the reversing slot, the positioning pillar comprising at least one spring slot that is in the elastic device.

15. The wrench structure for small-distance operations according to claim 9, wherein the first latching groove and the second latching groove are not equal to each other in dimension.

16. The wrench structure for small-distance operations according to claim 9, wherein the lateral angle offset is between 3 and 6 degree, or between 2 and 6 degree when the ratchet member has 60 teeth; wherein the lateral angle offset is between 2.5 and 5 degree, or between 1.67 and 5 degree when the ratchet member has 72 teeth; wherein the lateral angle offset is between 1.25 and 2.5 degree, or between 0.83 and 2.5 degree when the ratchet member has 144 teeth.

* * * * *